United States Patent [19]

Scheflow et al.

[11] Patent Number: 4,685,364

[45] Date of Patent: Aug. 11, 1987

[54] ROTARY SLICER FOR COMESTIBLE PRODUCTS

[75] Inventors: Oliver W. Scheflow, Avon Lake; William J. Roblin, III, Olmsted Township, Cuyahoga County, both of Ohio; Richard C. Kirsch, Norcross, Ga.; William G. Wunder, Hamilton, Mich.

[73] Assignee: Bettcher Industries, Inc., Birmingham, Ohio

[21] Appl. No.: 735,435

[22] Filed: May 17, 1985

[51] Int. Cl.[4] ..... B26D 1/16; B26D 7/12

[52] U.S. Cl. ..... 83/68; 83/155; 83/174; 83/355; 83/395; 83/399; 83/444; 83/467 R; 83/676

[58] Field of Search ..... 83/174, 490, 467 R, 83/594, 62, 70, 72, 74, 77, 155, 278, 366, 397, 399, 522, 676, 355, 68, 444, 419, 421, 395

[56] References Cited

U.S. PATENT DOCUMENTS

| | | | |
|---|---|---|---|
| 1,263,450 | 4/1918 | Maimin | 83/174 X |
| 1,366,568 | 1/1921 | Knapp . | |
| 1,559,468 | 10/1925 | Sowden . | |
| 1,607,879 | 11/1926 | Drucker | 83/676 |
| 1,907,620 | 5/1933 | Van Berkel . | |
| 2,166,648 | 7/1939 | Swafford . | |
| 2,193,979 | 3/1940 | Ott . | |
| 2,234,432 | 3/1941 | Gallo | 425/311 |
| 2,414,152 | 1/1947 | Jackson . | |
| 2,472,876 | 6/1949 | Ahrndt | 83/676 |
| 2,528,914 | 11/1950 | Roest | 83/467 |
| 2,617,454 | 11/1952 | Booth . | |
| 3,130,621 | 4/1964 | Else . | |
| 3,161,215 | 12/1964 | Werder et al. . | |
| 3,194,289 | 7/1965 | Lundell . | |
| 3,428,102 | 2/1969 | Knecht et al. . | |
| 3,530,915 | 9/1970 | Moriuchi . | |
| 3,590,678 | 7/1971 | Hasten et al. . | |
| 3,821,913 | 7/1974 | Bajcar et al. . | |
| 3,842,698 | 10/1974 | Fitch et al. . | |
| 3,867,858 | 2/1975 | Tsuchiya et al. . | |
| 3,972,256 | 8/1976 | Ross . | |
| 4,177,703 | 12/1979 | Cavier et al. . | |
| 4,428,263 | 1/1984 | Lindee et al. . | |

FOREIGN PATENT DOCUMENTS

| | | |
|---|---|---|
| 41096 | 2/1910 | Austria . |
| 413276 | 5/1925 | Fed. Rep. of Germany . |

*Primary Examiner*—Frank T. Yost

*Attorney, Agent, or Firm*—Watts, Hoffmann, Fisher & Heinke

[57] ABSTRACT

A rotary slicer 20 for comestible products. A stationary magazine 26 supports a product upright as a rotary table 38 carries a rotary knife 40 in an orbit that passes beneath the magazine. A freely rotatable center plate 80 of the blade facilitates movement of the blade through the product. Orbiting movement of the blade is automatically stopped with the blade remote from the magazine and electrical interlocks 109, 112 prevent operation without all protective safety covers 24, 102, 106 in place. A removable sharpener 172 is attachable to the top of table and operates with the blade flush with the table top. A product follower 118 within the magazine holds the product in place and urges it downward during slicing. The follower in part extends outward between the magazine 26 and magazine cover 106 to allow manual movement and release from a latched raised position, after the magazine cover is closed.

24 Claims, 14 Drawing Figures

ROTARY SLICER FOR COMESTIBLE PRODUCTS

TECHNICAL FIELD

This invention relates to a rotary slicer for comestible products and more particularly to a slicer in which a rotary blade orbits about an axis to slice product at a fixed location supported on a rotary table that moves with the blade.

BACKGROUND ART

Slicers of the present type are exemplified by apparatus of the construction shown in U.S. Pat. Nos. 2,414,152 and 3,428,102. Food product, such as meat, to be sliced, is held upright at a fixed location, slidable on a table that rotates about a vertical axis offset from the product location. A circular rotary driven blade extends above the table and moves with the table in an orbit about the table axis to intersect the product during each revolution of the table, thereby cutting successive slices the thickness of which is determined by the height of the blade above the table.

DISCLOSURE OF THE INVENTION

The present invention relates to a comestible rotary slicer with an orbiting blade that minimizes product drag of the blade; that controls the blade location when the slicer is stopped to ensure that the blade is inaccessible to the operator and does not underlie the product; that provides a removable sharpener securable to an upper surface of a rotary table that surrounds and moves with the blade in its orbit, positioned to avoid moving through the location where the product is positioned during slicing; that has a stationary product-supporting magazine with a pivoted safety cover and a product follower that can be automatically latched and held in a raised position to faciliate loading product and which can be raised, latched and released from outside the closed magazine; that provides a separate motor drive to adjust the table height to change the thickness of slices being cut; and that has safety interlocks that assure a protective cover is over the table and blade, the magazine and a magazine base are on the cover, and the magazine door is closed, before the slicer will operate. In addition, the slicer utilizes a conveniently removable motor drive unit and separable conveyor belt for receiving sliced product and carrying it from the slicer, and further utilizes novel blade construction.

Friction between the blade and product is minimized during slicing by using a disk-shaped blade with a radially thin annular face that slides against the product being sliced and by providing a flat, circular, freely rotatable, plate within the annular face to support the product as the blade passes through. Thus, although the edge of the blade is rotating and orbiting past the stationary product, the plate with its large area of product engagement will move relatively little with respect to the product. This significantly reduces the load on the machine and avoids product "smear," which is the drawing of fat from the surface of meat being sliced and the resultant deposit of the fat particles at the edge of the slice, which is unattractive. Reduction of drag also reduces the distortion of the product during slicing. Distortion typically results in "tailing," in which the trailing edge of each slice elongates and ends up a little thicker. When a large product is sliced the accumulated result of the distortion results in a wedge shaped piece at the end that cannot be sliced. The inner periphery of the annular blade face forms a labyrinth with the plate edge to inhibit entry of product scraps between the plate and blade. Openings through the blade adjacent the periphery facilitate automatic removal of any scraps that do enter.

The present invention provides a cover over the blade and rotary table, and a magazine and magazine base on the cover; but nevertheless, an opening in the cover for the product to pass through to the table necessarily exposes the blade if there is no product in the magazine and the blade is beneath the magazine. The present invention provides a sensor that determines when the blade is in a predetermined position along its path of orbit. When the power to the blade drive is turned off, the sensor will apply a brake when the blade is in the predetermined position and the blade orbiting will be stopped with the blade remote from the magazine so that only the rotary table is exposed through the cover opening. In addition to the safety advantage achieved, this prevents placing the product to be sliced directly on the blade when the machine is stopped, possibly resulting in a faulty cut, possibly damaging the sharp edge of the blade, and in any event applying an unnecessary extra load on the drive motor when the machine is started.

The predetermined stopped position of the rotary table and blade further facilitates the attachment of a blade sharpener by locating the portion of the table to which the sharpener is attached at a position either accessible through the cover opening, assuring that the sharpener can be safely attached and then used with the cover on the machine, or in any event adjacent the front of the machine, which can be conveniently reached. A small recess or cut-out in the table about the blade periphery is provided to receive the sharpening unit, which is easily attachable to the top surface of the table while the blade is flush with the top surface, eliminating the need to reach beneath the table or otherwise expose the operator to the blade edge during installation or operation of the sharpener. The sharpener is constructed and arranged to sharpen the blade with the table top surface flush with the blade cutting edge for safety. The sharpener includes both a grinder and a hone properly oriented automatically when the sharpener is attached. Locating pins and a spring-biased clamp secure the sharpener without threads or apertures in the table that tend to catch food particles and that are difficult to clean. The recess in the plate where the sharpener is attached is at a radial location that passes inwardly of the magazine location during table rotation so the locating pins do not interfere with the magazine.

A stationary product-receiving and -supporting magazine extends above the rotary table and partially surrounds an opening in the slicer cover through which the product extends when resting on the rotary table. The magazine has a base received on but removable from the cover and extends below the base to a location closely adjacent the top of the blade to minimize distortion of the product during slicing. The magazine is in the shape of a trough standing on its end, thus providing an open side into which product is loaded. A vertically pivotable transparent plastic door closes the open side. A product follower is receivable within the magazine and during slicing it rests on the product, urging it downward, and also retains the product in proper upright position by virtue of prongs that extend into the product and vertical guides on the magazine that constrain the follower to a vertical path of movement. A latch mechanism retains the follower in a raised position at the top of the magazine while a product is loaded. A handle for raising the follower and a trigger for releasing the latch mechanism are outside the magazine and door, interconnected to a portion within the magazine through a vertical slot between the door and magazine so the follower can be conveniently raised, latched and released with the door closed.

A safety interlock electrical circuit is provided to assure that the table cover is in place, the magazine is on the cover, and the magazine door is closed before the slicer can be operated. A magnet on the cover operates a proximity switch on the slicer stand when the table cover is in place. A second proximity switch on the stand is located to be actuated by a magnet on the magazine door, when the door is in a closed position. The two proximity switches are normally open and are actuated closed, and are in series with the power switch to the drive motor.

For carrying away sliced product, a conveyor drive unit and separable conveyor can be attached to the exterior of the slicer, with the conveyor extending beneath the rotary table and magazine in the product drop area. By making the conveyor conveniently separable from the drive unit, it can be easily cleaned.

The above and other features and advantages of the invention will become more apparent from the detailed description of a preferred embodiment, when considered in connection with the accompanying drawings.

BEST MODE FOR CARRYING OUT THE INVENTION

Figure 1:
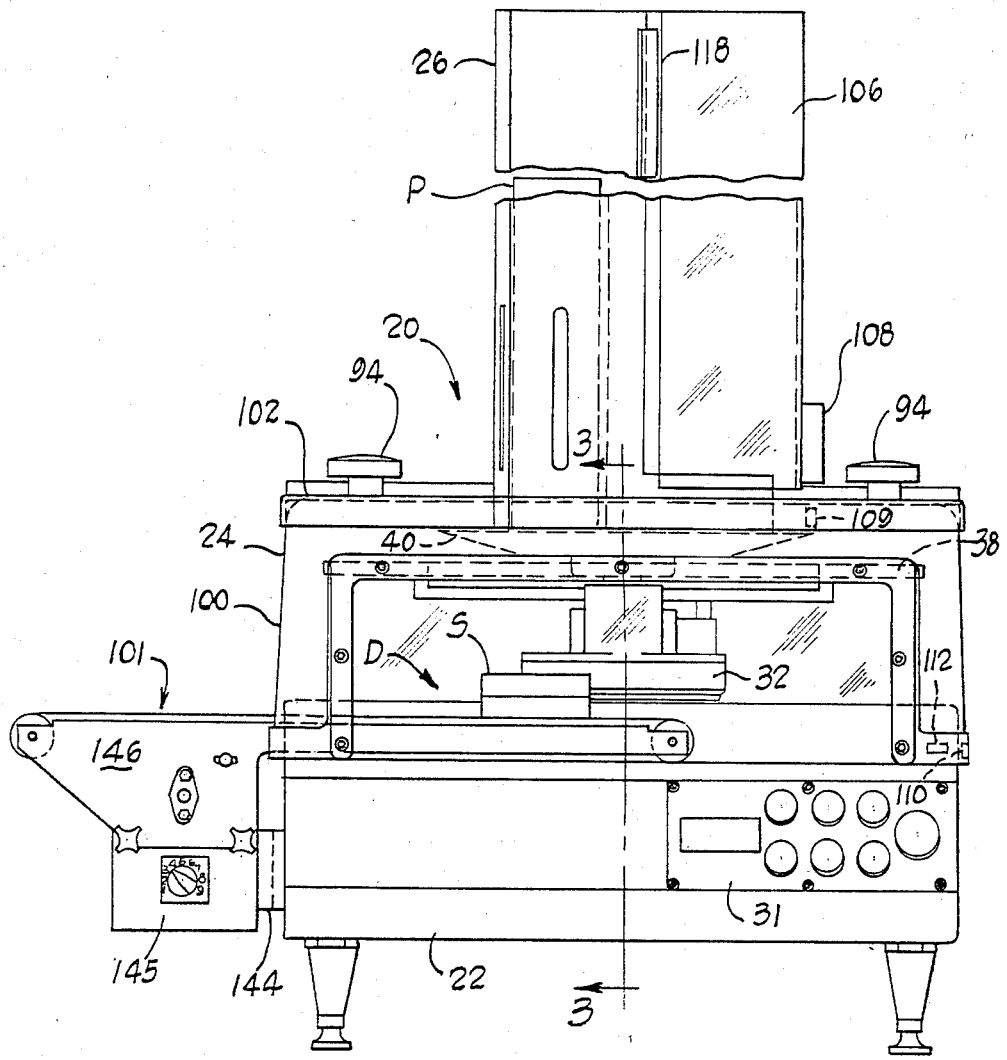
FIG. 1 is a front elevational view of a slicer embodying the present invention.
Figure 2:
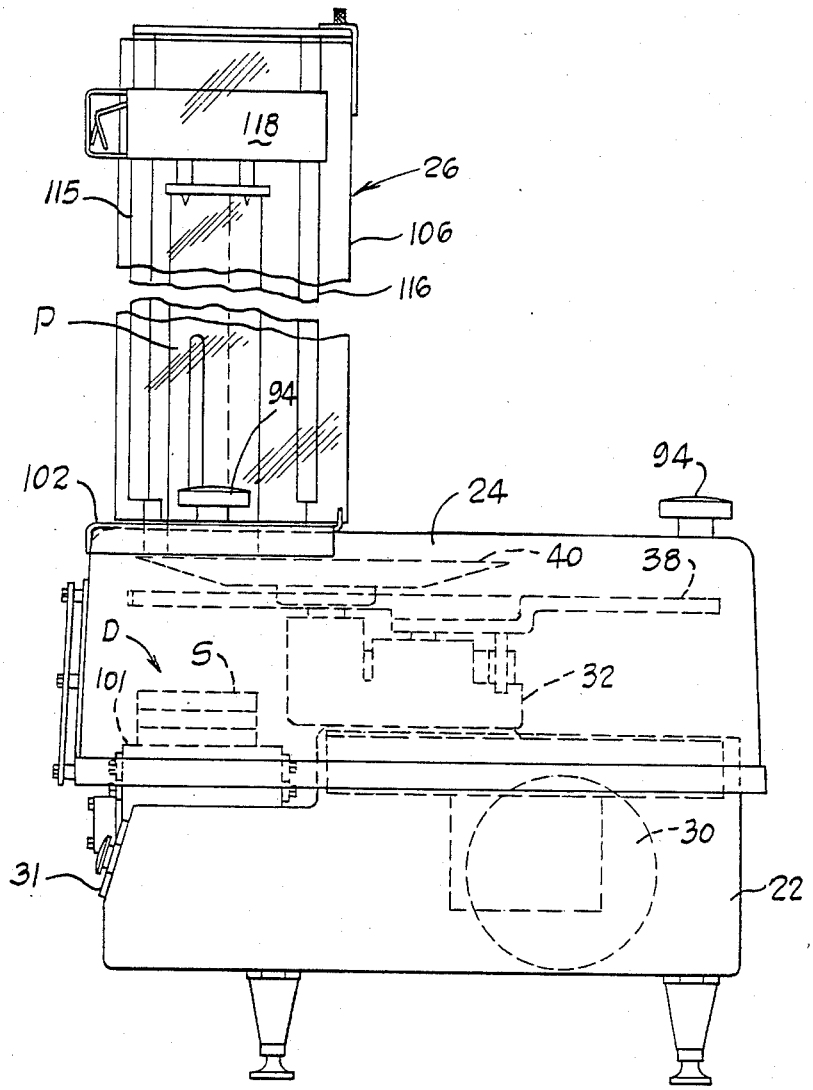
FIG. 2 is a side elevational view of the slicer of FIG. 1.
Figure 3:
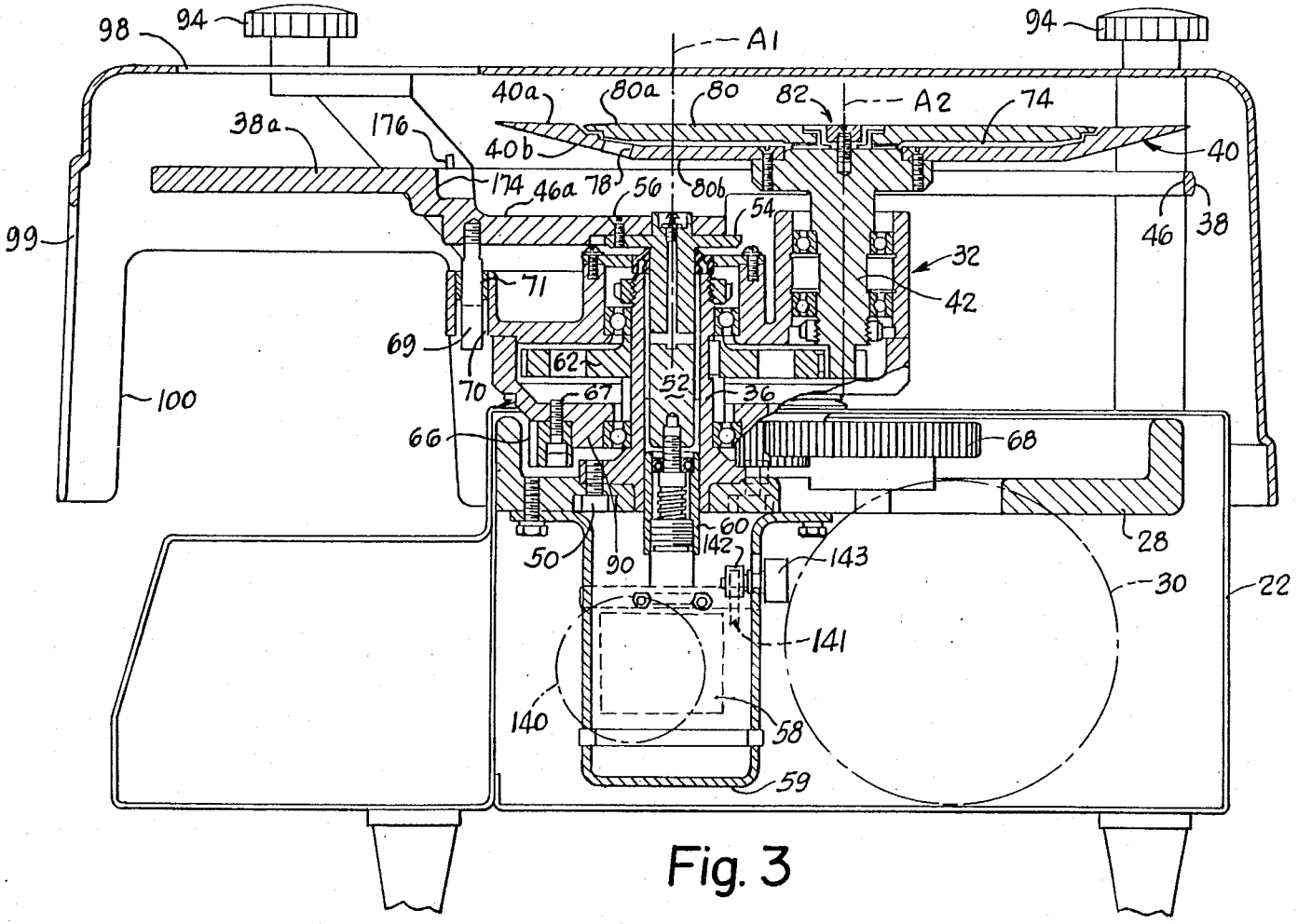
FIG. 3 is a sectional view taken along the line 3—3 of FIG. 1, but with the blade gear housing and table rotated 180°.

A slicer 20 embodying the present invention is shown in the drawings. With particular reference to FIGS. 1, 2 and 3, the slicer 20 has a lower cabinet 22, and an upper cabinet 24 supported on the lower cabinet, and a product magazine 26, supported on the upper cabinet.

The lower cabinet 22 houses and supports an internal frame 28 (FIG. 3), and a combination drive motor, transmission and brake unit 30. It also supports a control panel 31 and provides a product drop area D for receiving slices S of product P.

A rotatable gear housing 32 is supported for rotation above the lower cabinet 22 on a vertical stationary tubular shaft 36 (FIG. 3) extend upwardly from the lower cabinet.

A horizontal product support table 38 is supported for free rotation about the axis A1 of the tubular shaft 36 and is carried in rotation by the gear housing 32.

A circular slicing blade 40 is carried by a vertical rotating shaft 42 journaled in the gear housing 32, for rotation about an axis A2 parallel to and radially offset from the tubular shaft 36 and axis A1. Rotation of the gear housing 32 about the fixed tubular shaft 36 rotates the shaft 42 and blade 40 about the axis A2 and in addition orbits the blade and rotates the table 38 about the tubular shaft 36 and axis A1. The gear housing, table and blade are covered in use by the upper cabinet 24.

With the table 38 at a vertical level slightly below that of the blade and supporting a product to be cut, which is held stationary by the product magazine 26, rotation and orbiting of the blade 40 will cut a slice from the product each time the blade completes an orbit. An opening 46 in the table allows the slice that is cut to drop through the table to the product drop area on the lower cabinet. Vertical adjustment of the table relative to the blade changes the thickness of the slices. During the slicing, the product above the slice is supported on the circular blade and then drops onto the table after the blade moves past the product.

When a conveyor 48 is attached to the slicer, the product is received on a conveying belt 49 and after a stack of slices of a desired height or weight is received, the belt is indexed to move the stack from the drop area and receives subsequent slices on an adjacent surface of the belt.

With more particular reference to FIG. 3 of the drawings, the frame 28, which is directly secured to the lower cabinet, provides a horizontal support for the vertical tubular shaft 36, which is fixed in place to the frame by machine screws 50. A table support shaft 52 is freely rotatable and slidable within the fixed tubular shaft 36. The table 38 is firmly secured to a collar 54 at the top of the shaft 52, by screws 56. The table support shaft 52 is movable by a motordriven screw jack 58 secured by a mounting bracket 59 to the bottom side of frame 28. The table support shaft 52 is connected to the jack through a lift cartridge assembly 60 connected to the lower end of the support shaft 52 through a bearing that allows relative rotation, but that prevents relative axial movement.

A stationary gear 62 is keyed to the tubular shaft 36 within the gear housing 32, which is supported for rotation on the tubular shaft 36. The stationary gear 62 meshes with a smaller pinion 64 fixed to the lower end of the rotatable blade shaft 42 carried by the housing 32.

A ring gear 66 is secured externally to the housing 32, as by screws 67, and is driven by a pinion 68 from the motor, transmission and brake unit 30. The brake serves to automatically stop the rotation of the pinion 68 when the power to the motor is turned off.

As shown in FIG. 3, the blade shaft 42 extends upward through the opening 46 in the table 38. The diameter of the blade 40 is greater than the radius of the table 38 and a recess 46*a* is provided in the central portion of the table so that the table can be raised to a level where its top surface 38*a* is flush with the top surface 40*a* of the knife. A shaft 69 extends downward from the table 38 and is received in a bore 70 in the gear housing. A sleeve bearing within the bore facilitates relative rotation and axial movement between the shaft 69 and the housing. Thus, the shaft 69 provides an interconnection between the gear housing and table that rotates the table with the gear housing while allowing vertical movement of the table relative to the gear housing and blade to adjust the thickness of slices cut from a product.

Figure 4:
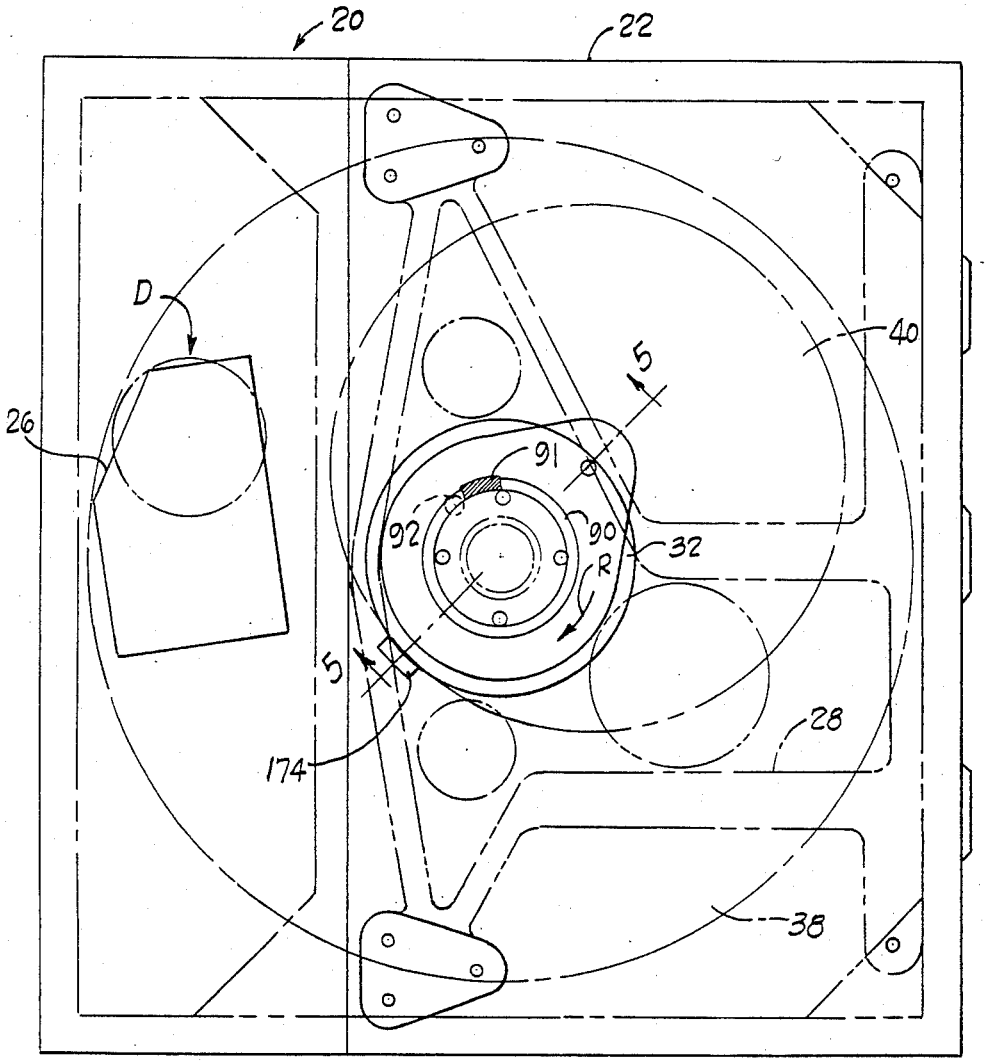
FIG. 4 is a diagrammatic top plan view of the table and knife support frame, gear housing and lower cabinet of the slicer, showing the proximity switch arrangement for positioning the blade.

The blade 40, as best shown in FIGS. 3 and 4, is disk-shaped and is dished to provide a central cavity 74. At the top surface 40*a*, the blade is in the form of a radially narrow flat ring that lies in a horizontal plane, whereas the lower surface of the blade adjacent the cutting edge is inclined in an upward and radially outward direction. The blade 40 is secured in the center to the top of the shaft 42 by spaced screws 76. Spaced circular apertures 78 (4 in the preferred embodiment) are provided in the disk-like blade, located in the inclined or conical portion 40*b*, radially inward from the ring-like top surface 40*a*.

A freely rotatable circular plate 80 is supported on the shaft 42, concentric with the blade, by a suitable bushing and nut assembly 82 and appropriate washers. The top surface 80*a* of the plate is essentially flush with the upper surface 40*a* of the blade and the lower surface 80*b* of the plate 80 is spaced from the central and conical portions of the blade 40 to form with the blade the cavity 74.

Figure 14:
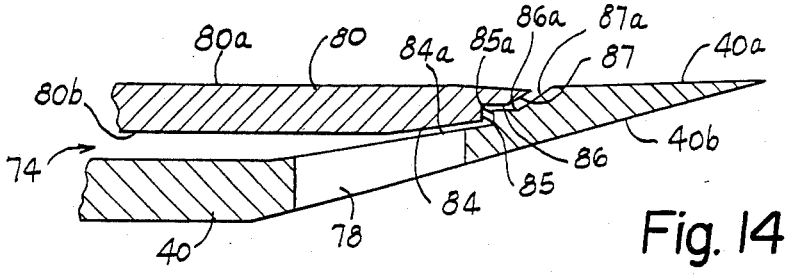
FIG. 14 is a partial enlarged sectional view of the cutting blade and center plate.

As best shown in FIG. 14, the plate 80 has at its periphery, an outwardly and upwardly angled annular portion 84 that terminates in a vertical peripheral wall portion 85, from which a horizontal flange surface 86 extends radially, terminating in an upwardly and outwardly beveled suface 87. Surfaces 84*a*, 85*a*, 86*a* and 87*a* formed in the upper surface of the blade, just interiorly of the ring-like top surface 40*a*, are parallel to and slightly spaced from the surfaces 84–87 of the plate 80, forming respectively a frusto-conical surface a radial surface and a second frusto-conical surface. The facing surfaces form a labyrinthine passage from outside the blade and plate to the cavity 74 between the two. The labyrinthine passage facilitates relative rotation between the blade and plate, while inhibiting entry of particles of the product that is cut. Product particles that do move through the passage from outside the blade and plate into the cavity 74 tend to be moved by centrifugal force outward and tend to migrate peripherally about the blade and are thereby expelled from the cavity through the openings 78.

During cutting, the blade 40, rotating and orbiting, slides relative to the product P as it moves through the product, to cut a slice therefrom. The annular top surface portion 40*a*, being very narrow, provides little frictional resistance to such movement. Instead, the major portion of the product being sliced is supported on the freely rotatable plate 80. Since that plate is not driven, and instead tends to stay as much as possible stationary with the work product through frictional engagement, and in fact tends to counter rotate relative to the rotating table 38, there is relatively little sliding and hence little friction loss between the blade and plate and the work product. Thus, this construction reduces both surface smear of the product and power consumption.

Figure 5:
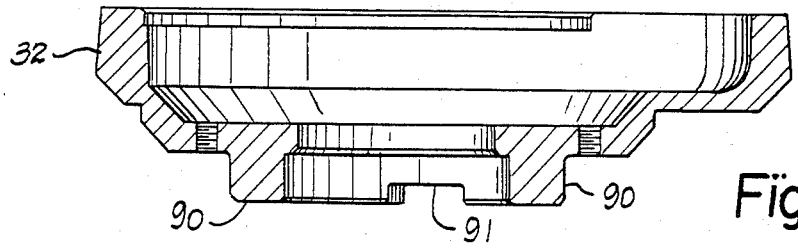
FIG. 5 is a partial sectional view taken along the line 5—5 of FIG. 4 showing the lower half of the gear housing.

To assist in locating the blade 40 in the back position, out of the drop area, i.e., remote from the magazine, when the machine is stopped, the gear housing is formed to facilitate detection of a particular rotational position by a proximity switch on the frame. In the preferred embodiment, an annular flange 90 (FIGS. 3 and 5) extends downward from the lower surface of the housing and is surrounded by the ring gear 66. A notch 91 is formed in the lower surface of the flange, as best shown in FIG. 5. The absence of the flange where the notch is located is sensed by a capacitive-type proximity switch 92 (FIG. 4), located in the position shown in FIG. 4. When the power is turned off to the drive motor and the notch is sensed by the proximity switch as the housing is rotated in the direction of the arrow R, the brake on the motor, transmission and brake unit 30 is applied and rotation of the gear housing and table is stopped within about 90° of rotation to locate the blade behind the drop area and magazine.

The upper cabinet 24 that covers the table 38 and blade 40 is in the form of a shell that fits over the lower cabinet 22 and is supported by the frame 28 and secured thereto by four knobs 94 adjacent corners of the cabinet that screw into the frame. The upper cabinet overlies the drop area D and has an opening 98 (FIG. 3) through a top portion for the product to extend as it rests on the table 38. The upper cabinet has an opening 99 in the front surface, with a transparent cover to permit viewing of the drop area. The upper cabinet has a further opening 100 at the left end (as viewed in FIG. 1) of the drop area, as best shown in FIG. 3. The opening 100 permits removal of the product that has been cut, and facilitates entry and support of the conveyor 48 in the drop area.

Figure 6:
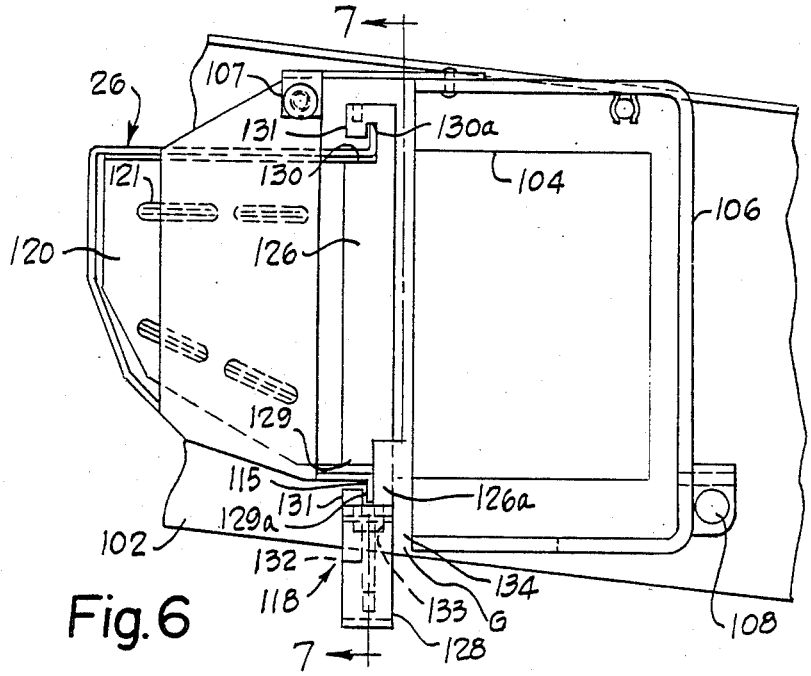
FIG. 6 is a partial top plan view of the slicer of FIG. 1 showing the magazine and product follower.

The product magazine 26 is supported on the upper cabinet 24 by an enlarged magazine base 102 (FIGS. 1 and 2) that is located over the opening 98 and secured in place by two of the knobs 94. As best shown in FIG. 6, the magazine base 102 has an opening 104 that is aligned with the opening 98 in the upper cabinet. Approximately one-half of the opening 104 is surrounded by the magazine 26, which is an upright trough-shaped metal affair secured adjacent the bottom to the base 104, but with its bottom edge extending slightly below the base to adjacent the level of the upper surface of the blade 40.

Figure 7:
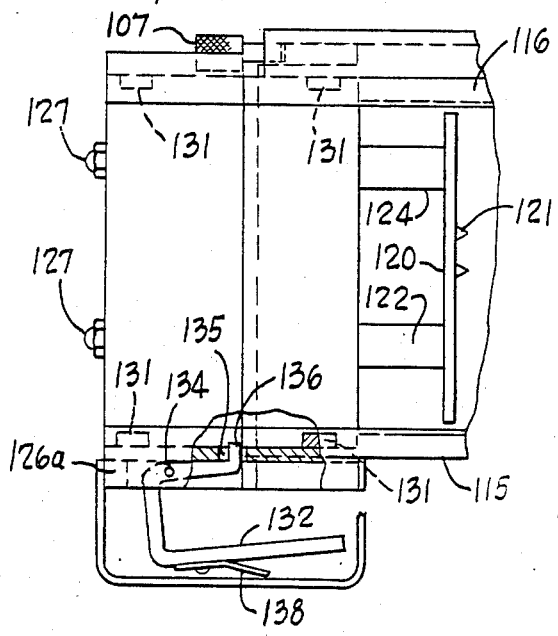
FIG. 7 is a front elevational view, partially in section, of the product follower of FIG. 6.

A magazine door or cover 106, also trough-shaped, is secured to and pivoted along one vertical edge of the magazine by upper and lower pivot pins 107 as shown in FIGS. 6 and 7. When the cover is closed it surrounds the remainder of the opening 104. The cover 106 carries a magnet 108 on a lower portion, that operates a proximity switch 109 carried by the frame 28 just beneath the upper cabinet (see FIG. 1) located to underlie the magnet when the cover 106 is in a closed position. In addition, the upper cabinet carries a magnet 110 that operates a proximity switch 112 on the frame. The proximity switches 109, 112 are in series with a "power on" switch to the drive motor, so that only when the two proximity switches are closed by the presence of the magnets 108, 110, respectively, will the blade be operated. As a result, the upper cabinet must be in place over the lower cabinet, the magazine and magazine base must be in position over the upper cabinet, covering the opening 98, and the door 106 to the magazine must be in a closed position before the slicer can operate.

The magazine 26 has two guide flanges 115, 116 that extend vertically the height of the magazine and outwardly from the open front of the trough-like shape. These flanges serve to guide vertical movement of a product follower 118 that engages the top or upper end of a product P in the magazine and urges the product downward. The follower is also held within the magazine by the guide flanges to retain the product in a vertical position against the back of the magazine, so the product does not move when contacted by the slicing blade.

The product follower 118 has a relatively flat horizontal plate 120 that fits within the magazine. The plate has tines 121 extending downward from a lower surface, to engage the product. Two posts 122, 124 extend upward from the plate and engage the bottom edge of a generally flat, vertical body 126 that spans the transverse distance of the opening of the trough and that receives the flanges 115, 116 in vertical grooves 129, 130. The posts 122, 124 are connected to the body by rods that extend vertically through the body and are secured at the top of the body by nuts 127. The grooves 129, 130 each carry two bosses 131 adjacent the top and bottom, that define a slot 129*a*, 130*a* that closely receives the guide flanges 115, 116. A U-shaped handle 128 extends from one side 126*a* of the body 126. That side portion of the body extends through a narrow vertical gap G between the magazine 26 and the cover 106, when the cover is closed. The handle has a trigger latch 132 partially received in a vertical side slot 133 and pivoted to the body 126 by a cross-pin 134 (FIGS. 6 and 7) extending across the side slot. The trigger latch has a latch portion 136 that extends laterally through an opening 135 into the groove 129 and into the path of the guide flange 115 under the force of a leaf spring 138 secured to the trigger latch and acting against the U-shaped handle.

When the product follower is raised to an upper position, so that the latch portion 136 is above the top of the guide flange 115, as illustrated in FIG. 7, the latch portion 136 moves inward to engage the top of the flange and prevents downward movement of the follower. In this way, the follower is automatically retained in its raised position while a product is inserted to the magazine. The inserted product rests on its lower end upon the table 38, passing through the opening 104 in the magazine base and the opening 98 in the upper cabinet. By pulling the trigger 131 toward the handle 128, an operator can remove the latch portion 136 from over the flange 115, allowing the follower to be lowered and to rest upon the top end of the product in the magazine. Thereafter, the weight of the follower will urge the product downward as slices are removed from the bottom end. When the follower reaches the bottom of the magazine, the handle 128 engages the magazine base 102 and prevents the follower from going below the magazine base and into the path of the cutter blade.

The jack screw 58 that raises and lowers the table 38 is driven by an electric motor 140 (FIG. 3) supported by the bracket 59. A rack 141 carried vertically by the jack screw rotates a pinion 142 on the shaft of a potentiometer 143 that operates a gauge on the control panel 31 to indicate the position of the table and, hence, the thickness to which the slicer will cut slices from the product.

Figure 8:
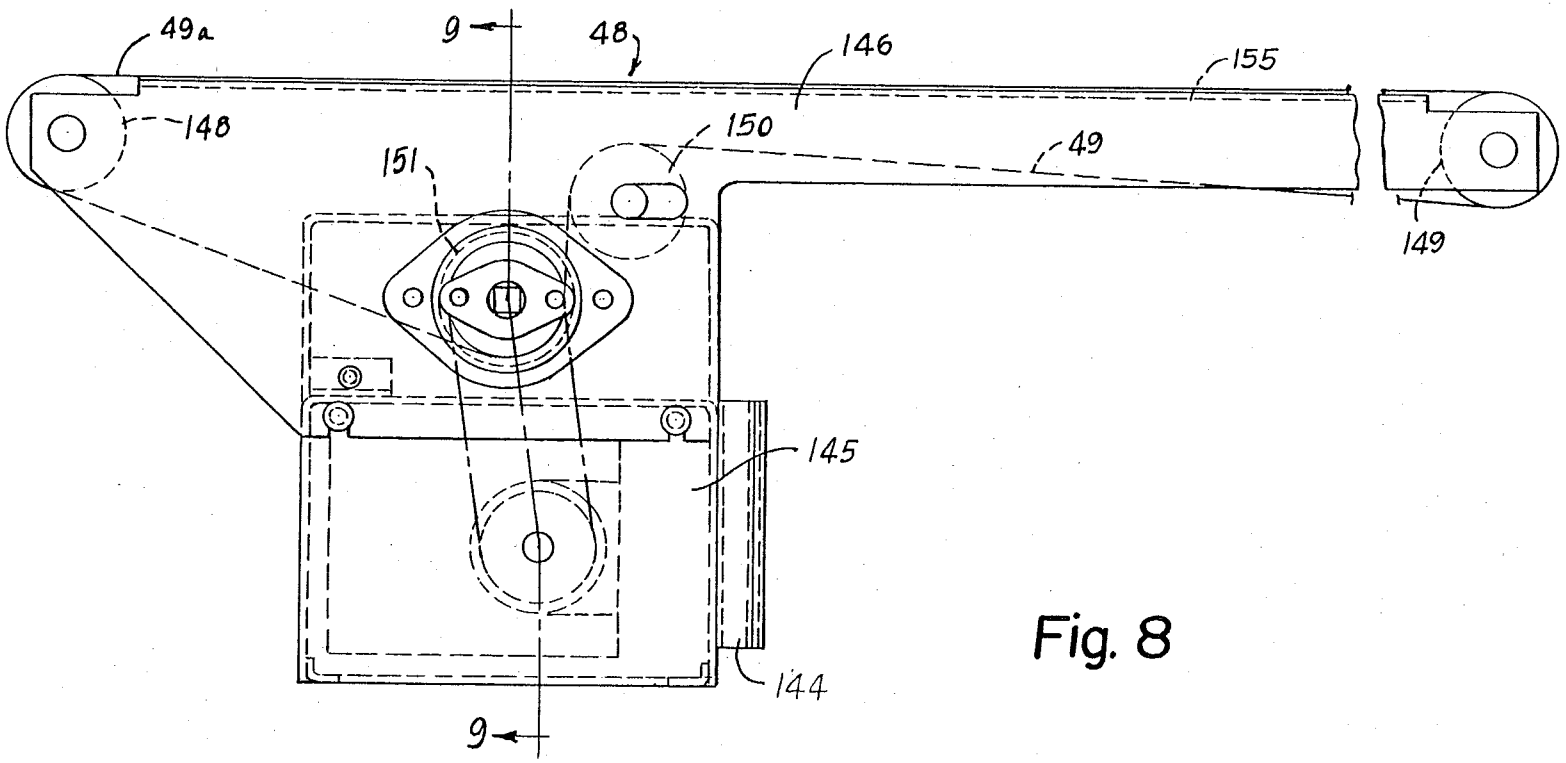
FIG. 8 is a partial front elevational view similar to FIG. 1, but showing details of a conveyor.
Figure 9:
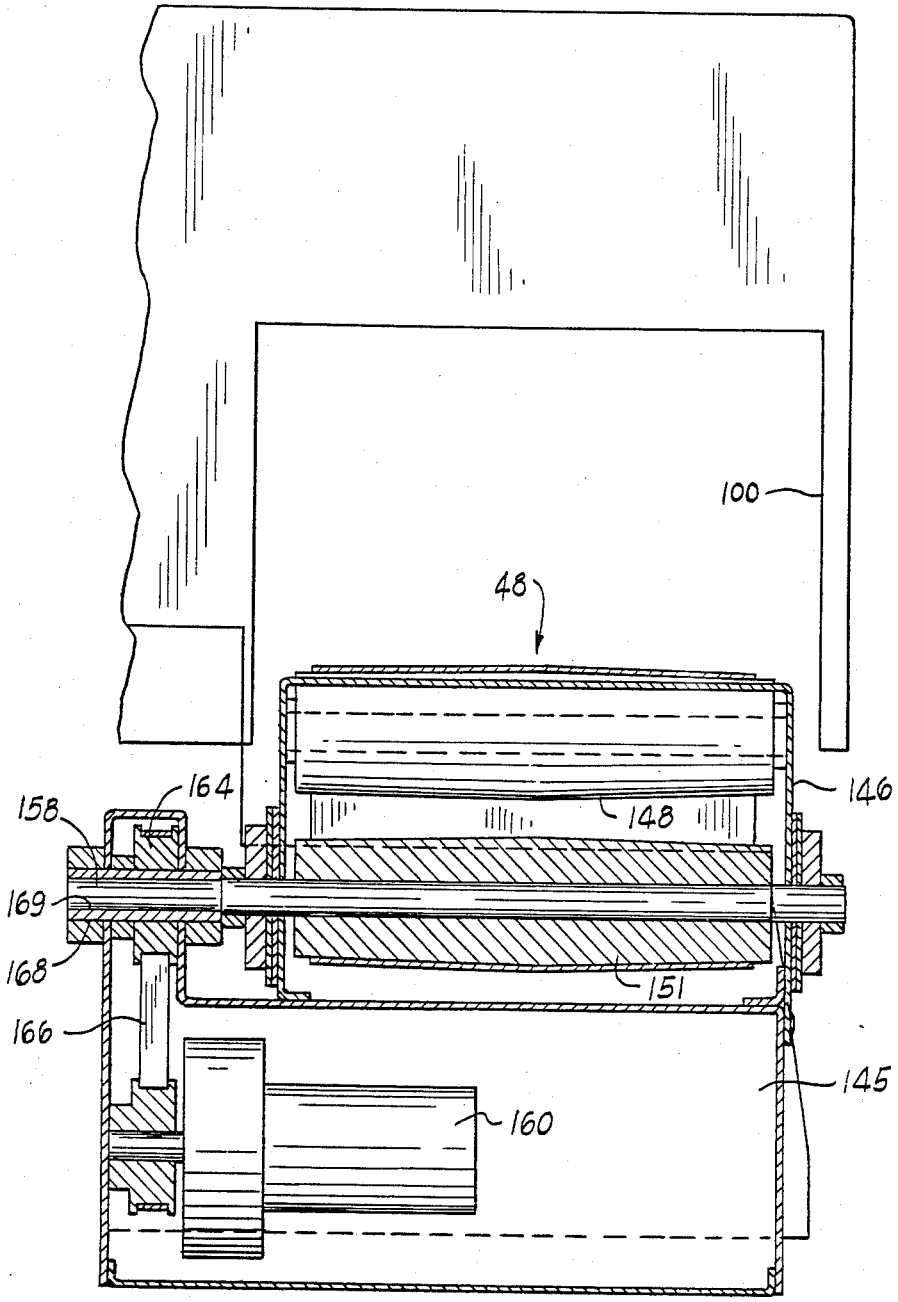
FIG. 9 is a view partially in section and partially in elevation taken along the line 9—9 of FIG. 8.

If it is desired to automatically remove sliced product from the drop area of the apparatus, the conveyor 48 is attached by a bracket 144 to one side of the lower cabinet 22 (see FIGS. 1 and 8) and extends through the opening 100 of the upper cabinet and into the drop area D, beneath the magazine. The conveyor is comprised of two separable parts, a drive part 145 and a product carrying part 146 supported on the drive part. The product carrying part has three idler rollers 148, 149, 150 and one drive roller 151, with the belt 49 trained about the rollers and an upper reach 49*a* supported by a horizontal plate 155. The drive roller 151 has an outwardly extending square stub shaft 158 (FIG. 9) that drives the roller.

The drive part 145 of the conveyor has an electric motor drive 160 connected to a driving pulley 162. It has a driven pulley 164 connected to the driving pulley by a transmission belt 166. The driven pulley 164 is on a shaft 168 that has a square socket 169 and that is aligned with and receives the shaft 158. With this arrangement, the two parts 145, 146 can be easily separated by slidably separating the shafts 158, 168, which facilitates cleaning of the product carrying part 145. The electric motor drive 160 is controlled to allow either continuous operation or indexing movement to carry sliced product from the drop area within the upper cabinet to the end of the conveyor 101 that is outside the cabinet. The entire unit is easily removed from the slicer by lifting it from the bracket 144, when the conveyor is not required.

A removable sharpener 172 for grinding and honing the blade 40 is shown in FIGS. 10–13. A small recess 174 is formed in the table 38 along the aperture 46 at the location best shown in FIG. 4, to receive the sharpener. The recess extends peripherally approximately 15 angular degrees and is at that portion of the periphery of the aperture 46 that is diametrically opposite the blade shaft 42 relative to the axis A1, which places it radially at a location that is always inward of the magazine 26. Two vertical pins 176, 177 extend from the upper surface 38*a* of the table, one on each side of the recess to receive and locate the sharpener.

Figure 10:
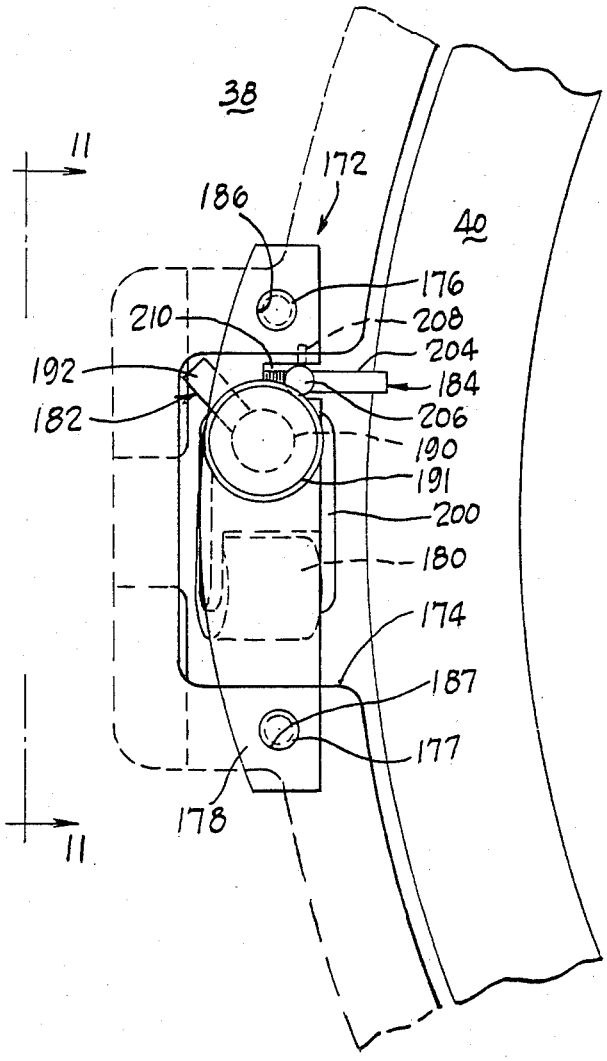
FIG. 10 is a partial top plan view of the table and blade, showing a blade sharpener secured to the table in a position disengaged with the blade.
Figure 11:
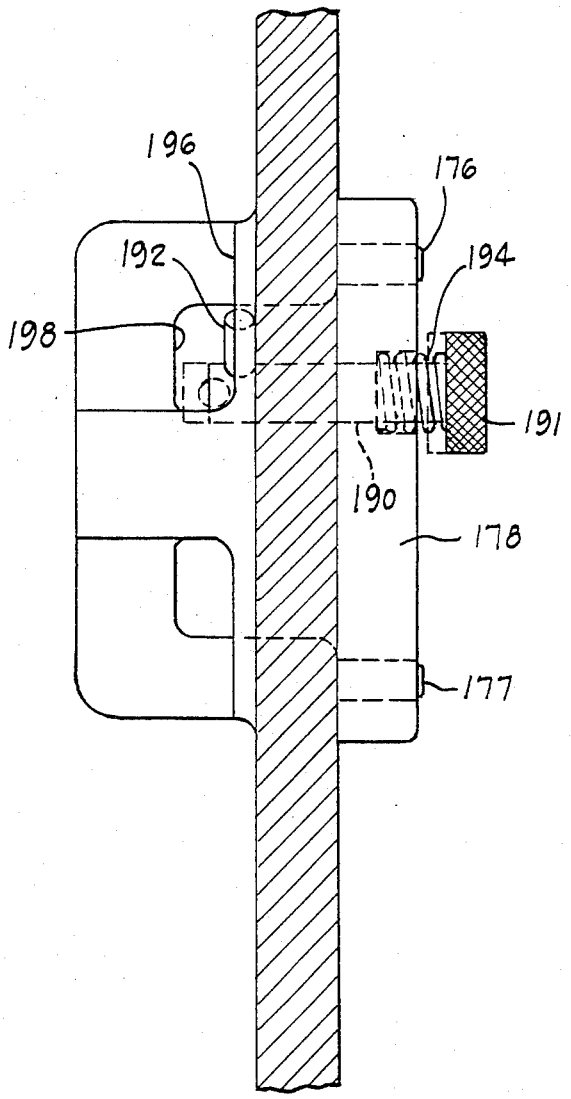
FIG. 11 is a partial view, partly in side elevation and partly in section taken along the line 11—11 of FIG. 10.
Figure 12:
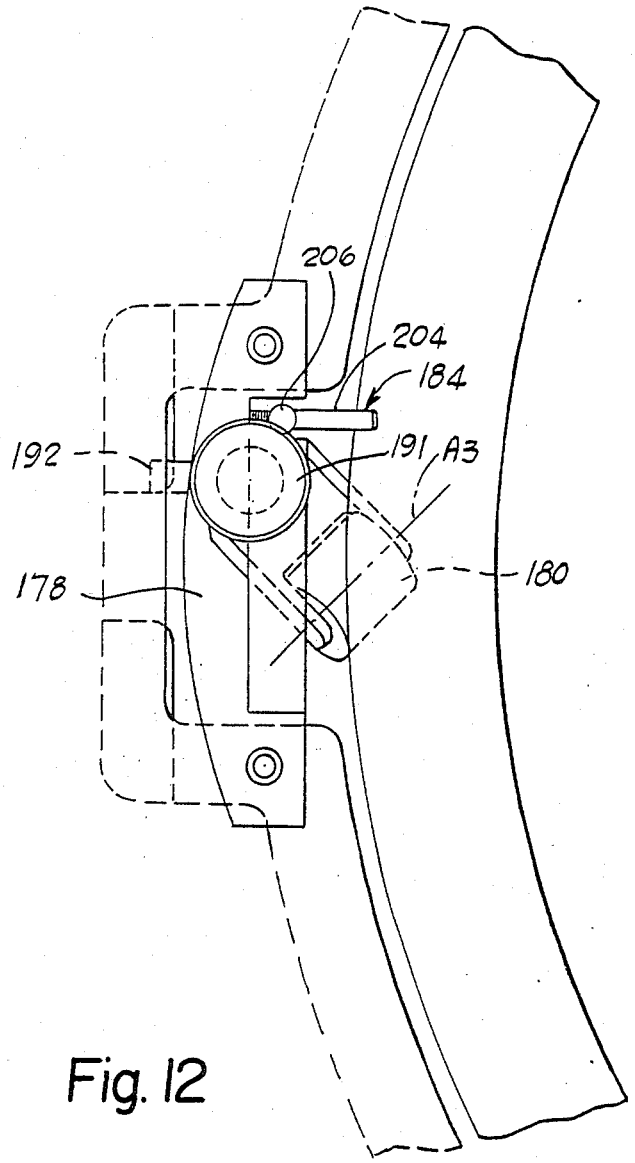
FIG. 12 is a partial top plan view similar to FIG. 10, but showing the sharpener in a position engaged with the blade.
Figure 13:
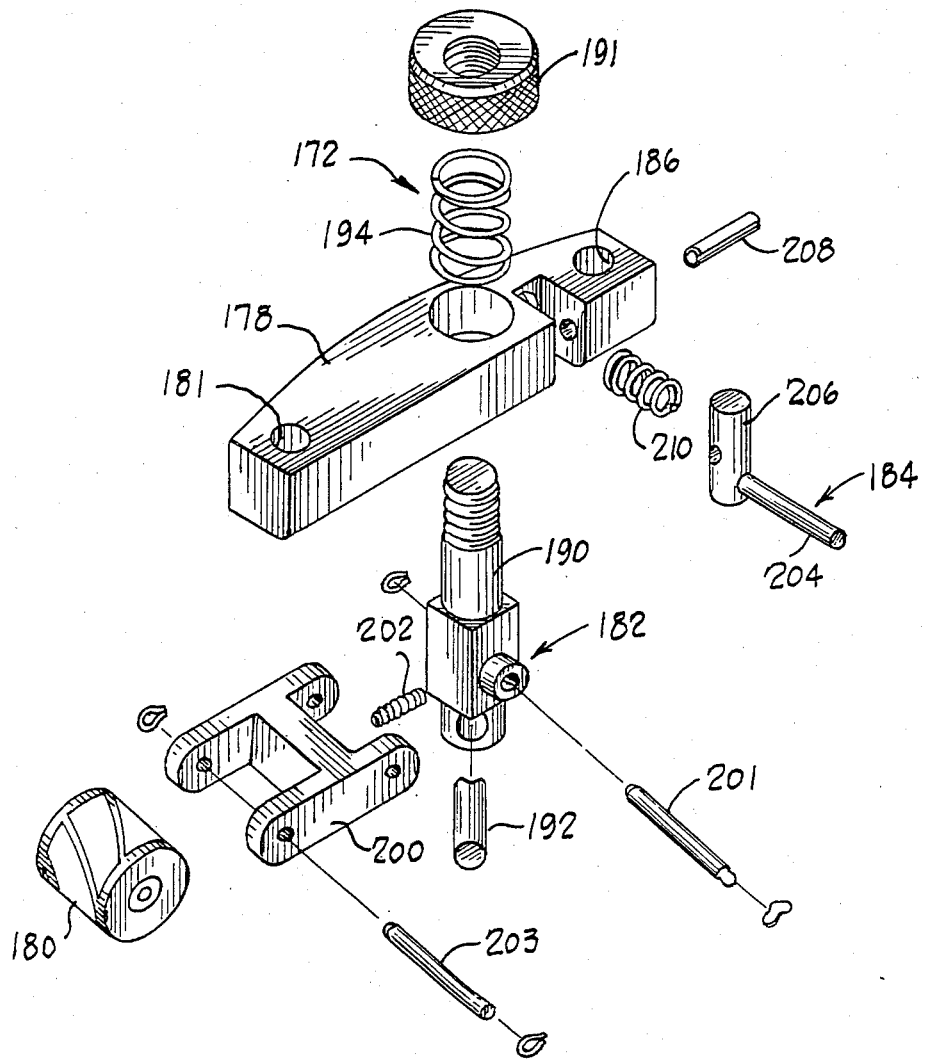
FIG. 13 is an exploded view of the sharpener of FIGS. 10-12.

The sharpener 172 has a support body 178 that spans the recess 174, a grinding drum 180 that fits within the recess, a clamp mechanism 182 that passes through the recess and engages the underside of the table, and a hone 184 that extends outward from the recess across the top edge of the blade. The body 178 has two apertures 186, 187 for slidably receiving the pins 176, 177. A shaft 190 of the clamp mechanism extends through the body and has a top knob 191 above the body and a locking pin 192 extending radially from the shaft below the body a sufficient distance to fit beneath the table. The shaft is rotatable and slidable in the body. A compression spring 194 about the shaft 190 acts between the body and knob to bias the pin 192 toward the underside of the table. The pin swings about the axis of the shaft 190 when the knob 191 is rotated. As shown in FIG. 10, when the pin is in a disengaged position, there is space in the recess for the pin to move through the recess from above the table 38 to below the table as the sharpener is placed on the pins. When the knob 191 is then pressed toward the body 178 the pin moves below an abutment 196 (FIG. 11). By then rotating the knob 45°, the pin is moved into a notch 198 and retains the body on the pins and against the table top.

The grinding drum 180 is attached to the shaft 190 beneath the body by a clevis-like pivoted arm 200 on a cross pin 201. A compression spring 202 acts between the shaft and arm to bias the arm and drum upward about the pin 201 toward the body 178. The drum and arm are located essentially within the thickness of the table and within the recess 174 in the disengaged position. When the shaft 190 is rotated 45° to engage the locking pin 192 in the notch 198, the grinding drum is moved out of the recess and into contact with the lower edge of the periphery of the cutter blade, with the axis A3 of the drum at 45° from a tangent to the blade edge where the drum contacts the blade and slightly inclined relative to the longitudinal axis of the shaft 190 an amount corresponding essentially to the bevel on the lower surface of the blade. The drum is freely rotatable about its axis A3 on a pin 203 and the arm 200 is biased upward by the spring 202 to engage the drum with the blade, so the drum rotates about its axis A3 when the blade is driven about its axis A2.

The hone 184 has a rod 204 extending substantially radially of the blade, overlying the top surface 40*a*. The rod extends from a vertical member 206 (FIG. 13) pivoted on the body 178 by a horizontal pin 208 that extends at a right angle to the rod 204. The member 206 extends above the pivot pin and is urged toward the blade by a compression spring 210, which yieldably urges the hone against the edge and top surface of the blade.

While the operation of the slicer will be apparent from the previous desciption, it can be summarized as follows. With the power to the slicing machine off and the blade 40 in its back position remote from the magazine 26, where it was automatically located when the machine was last stopped, and with the upper cabinet 24 and the product magazine 26 in place, and with the door 106 to the magazine open, the machine will not start and is ready to be loaded with a product to be sliced. The product follower 118 is raised to the top of the magazine and is automatically latched in its raised position by the trigger latch 132. A product to be sliced is inserted into the magazine and rests on its lower end upon the table 38. The door or cover 106 to the magazine is closed, the latch portion 136 is released by operating the trigger 132 and the product follower is then lowered into contact with the top of the product. The machine is now ready to be operated to slice the product by energizing the motor unit 30.

If the height of the table 38 requires adjustment to change the slice thickness, the motor 140 is operated to move the shaft 52 and table 38 vertically. The drive motor 30 is then turned on and the gear housing 32 is driven in rotation about the stationary tubular shaft 36 and the fixed gear 62, causing the table 38 to rotate about axis A1 and the blade 40 to spin at a significantly faster rate about its central axis A2 as the blade orbits about the central axis A1 of the table. Because the blade is initially in a position out of contact with the product, the rotation of the table and blade can be easily started, gaining momentum before the blade reaches the product. The blade intersects and passes through the product and the sliced piece drops through the opening 46 in the table 38 and into the product drop area D and onto the conveyor 48. If the conveyor is in an indexing mode, several slices are stacked on the conveyor, one on top of the other, one piece being cut for each revolution of the table. The conveyor is then indexed and a second stack of slices formed adjacent the first, and so on.

While a preferred embodiment of the invention has been dislosed in detail, it will be appreciated that various modifications and alterations can be made therein, without departing from the spirit and scope of the invention set forth in the appended claims.

We claim:

1. In a slicer for comestible products having a base, a support on the base rotatable relative to the base about a first axis, a circular blade carried by the support and rotatable relative to the support about a second axis parallel to the first, a table rotatable with the support, said table and blade being adjustable axially relative to one another, means to rotate the support relative to the base, means to rotate the blade relative to the support, a circular center plate within the perimeter of the blade and movable with the blade about the first axis and the plate freely rotatable about the second axis relative to both the blade and the support, the improvement wherein the blade is a disk with a peripheral cutting edge and dished contour that provides a cavity between the center plate and blade and wherein the plate has a peripheral contour and the blade has a surrounding contour mating therewith radially inward of the cutting edge, said peripheral and surrounding contours being slightly spaced from each other and shaped to form a labyrinthine passage between the blade and plate from outside the blade and plate to the cavity between the blade and plate, and the blade has peripherally spaced apertures beneath and adjacent the periphery of the plate opening into said cavity.

2. In a slicer for comestible products having a base, a support on the base rotatable relative to the base about a first axis, a circular blade carried by the support and rotatable relative to the support about a second axis parallel to the first, a table rotatable with the support, said table and blade being adjustable axially relative to one another, means including a first electric motor to rotate the support relative to the stand, means fo rotate the blade relative to the support, a freely rotatable circular center plate within the perimeter of the blade and movable with the blade about the first axis, a second electric motor, means driven by the second motor to move the table along said first axis relative to the blade, said table being rotatable relative to said driven means, a potentiometer, transmission means to adjust the potentiometer in response to axial movement of the rotatable table, and an electrically operated guage responsive to the potentiometer for indicating the position of the table relative to the blade.

3. A rotary blade for a comestible product slicer, said blade being circular and dish shaped, having a relatively narrow annular planar face that has an outer periphery that forms a cutting edge and that has an inner periphery adjacent the planar face formed in a series of connected concentric surfaces including, in order, a first frusto-conical surface, a radial surface, a cylindrical surface extending from the radial surface axially away from the planar face, and a second frusto-conical surface, said blade having a third generally frusto-conical surface angularly related to the annual planar face and intersecting therewith at the cutting edge, and said blade further having peripherally spaced openings through said third surface adjacent and radially inward of said inner periphery.

4. In a slicer for comestible products having a base, a support on the base rotatable relative to the base about a first axis, a circular blade carried by the support and rotatable relative to the support about a second axis parallel to the first, a table rotatable with the support, said table and blade adjustable axially relative to one another, means to rotate the support, means to rotate the blade relative to the support, a magazine fixed relative to the base adjacent the table and offset from said first axis for holding a product in a position for movement toward the table for slicing, the improvement wherein the support includes a gear housing having a housing portion that rotates with and in a plane parallel to the table past a predetermined location on the base and that has means for indicating a predetermined rotational position of the gear housing relative to said location on the base, whereby the table position can be detected and rotation can be stopped at a location where the blade is remote from said magazine.

5. A slicer as set forth in claim 4 wherein the means to rotate the support includes an electric motor, the sensing means includes a proximity switch supported on the base that senses a predetermined position of apparatus rotating about said first axis, wherein a power switch is provided for the motor, and braking means is provided, responsive to operation of both the power switch and the proximity switch, to stop rotation of the support.

6. In a slicer for comestible products having a base, a support on the base rotatable relative to the base about a generally vertical first axis, a circular blade carried by the support and rotatable relative to the support about a second axis parallel to the first, a generally horizontal table rotatable about its center with the support, said table having an opening offset from the center, through which the second axis extends, said table and blade being adjustable axially relative to one another, means to rotate the support, means to rotate the blade relative to the support, an upright magazine fixed relative to the base above the table and offset from said first axis for holding upright a product supported on the table for slicing, the improvement wherein the magazine has an open upright side, a pivotal cover for closing said upright side to retain product in the magazine, a narrow vertical opening along the magazine, a product follower within and movable vertically relative to the magazine, said follower including means cooperable with the magazine to releasably restrain the follower from vertical movement by gravity toward the blade and a mechanism outside said magazine and cover for operating said restraining means, said follower in part extending through said vertical opening.

7. A slicer as set forth in claim 6 wherein said vertical opening extends between the magazine and cover, and the follower includes a generally horizontal plate within the magazine, a latch that retains the follower in a raised position at an upper end of the magazine, and a hand-operated latch release outside the magazine and cover.

8. In a slicer for comestible products having a base, a support on the base rotatable relative to the base about a first axis, a circular blade carried by the support and rotatable relative to the support about a second axis parallel to the first, a table rotatable about its center with the support, said table having an opening offset from the center, through which the second axis extends, said table and blade being adjustable axially relative to one another, means to rotate the support, means to rotate the blade relative to the support, a magazine fixed relative to the base adjacent the table and offset from said first axis for holding a product in a position for movement toward a product-locating surface of the table for slicing, a portion of the table at said opening being at a radial location from the center that does not pass opposite the magazine, the improvement wherein said portion of the table includes means on the product-locating surface of the table for releasably receiving a removable blade sharpener.

9. A slicer as set forth in claim 8 wherein said portion of the table includes a recess in the periphery of the opening, and said slicer further includes a blade sharpener located in part in said recess.

10. A slicer as set forth in claim 9 wherein the means on the product-locating surface of the table is two projecting pins and the sharpener includes a body that spans the recess and that has apertures that receive the pins, a clamping member on the body that engages an opposite surface of the table from the product-locating surface, a sharpening member carried on the body for movement between a location within the recess and a location extending from the recess and engageable by the blade, and means above the top surface of the table for moving the sharpening surface between said locations.

11. A slicer as set forth in claim 10 wherein the means for moving the sharpening surface also operates the clamping member.

12. In a slicer for comestible products having a base, a support on the base rotatable relative to the base about a first axis, a circular blade carried by the support and rotatable relative to the support about a second axis parallel to the first, a table rotatable with the support, said table and blade being adjustable axially relative to one another, means to rotate the support relative to the stand, means to rotate the blade relative to the support, an upright magazine fixed relative to the stand above the table and offset from said first axis for holding upright a product supported on the table for slicing, and a circular center plate within the perimeter of the blade and movable with the blade about the first axis, the improvement wherein the center plate is freely rotatable about the second axis relative to both the blade and the support, and means is provided for sensing a rotational position of the blade about the first axis during rotation of the support and for stopping the rotation with the blade located at a position other than beneath the magazine.

13. A slicer as set forth in claim 12 wherein the means to rotate the support includes a electric motor, the sensing means includes a proximity switch supported on the frame that senses a predetermined position of the apparatus rotating about said first axis, wherein a power switch is provided for the motor and braking means is provided, responsive to operation of both the power switch and the proximity switch, to stop rotation of the frame.

14. In a slicer for comestible products having a base, a support on the base rotatable relative to the base about a first axis, a circular blade carried by the support and rotatable relative to the support about a second axis parallel to the first, a table rotatable with the support, said table and blade being adjustable axially relative to one another, means to rotate the support relative to the stand, means to rotate the blade relative to the support, an upright magazine fixed relative to the stand above the table and offset from said first axis for holding upright a product supported on the table for slicing, and a circular center plate within the perimeter of the blade and movable with the blade about the first axis, the improvement wherein the center plate is freely rotatable about the second axis relative to both the blade and the support, means is provided for sensing a rotational position of the blade about the first axis during rotation of the support and for stopping the rotation with the blade located at a position other than beneath the magazine, said magazine has an open upright side, a pivotal cover for closing said upright side to retain product in the magazine, and a product follower within and movable along the magazine, said follower including means to releasably restrain the follower from downward movement, and a mechanism outside said magazine and cover for operating said restraining means.

15. In a slicer for comestible products having a base, a support on the base rotatable relative to the base about a first axis, a circular blade carried by the support and rotatable relative to the support about a second axis parallel to the first, a table rotatable with the support, said table and blade being adjustable axially relative to one another, means to rotate the support relative to the stand, means to rotate the blade relative to the support, an upright magazine fixed relative to the stand above the table and offset from said first axis for holding upright a product supported on the table for slicing, and a circular center plate within the perimeter of the blade and movable with the blade about first axis, the improvement wherein the product support table is freely rotatable about the second axis relative to both the blade and the support and includes means on a top surface of the table at a radial location from the center that does not pass beneath the magazine, for releasably receiving a removable blade sharpener, and means is provided for sensing a rotational position of the blade about the first axis during rotation of the support and for stopping the rotation with the blade located at a position other than beneath the magazine.

16. A slicer as set forth in claim 30 wherein said table includes an opening in the table in which the blade can be received, a recess in the periphery of the opening, and a blade sharpener in part located in said recess and in part on and secured to the top surface of the table.

17. A magazine and product follower for a comestible-slicing machine comprising an elongated trough-like upright wall with an open upright side for receiving and guiding a product to be fed longitudinally of the trough-like wall toward a blade for slicing, a cover pivoted to the wall for closing the open side, a narrow longitudinal opening along the magazine, a product follower within and movable along the magazine, said follower including means cooperable with the magazine to releasably restrain the follower from movement by gravity along the magazine in the direction the product is fed along the magazine, and a mechanism outside said magazine and cover for operating said restraining means, said mechanism extending through said longitudinal opening.

18. A magazine and product follower as set forth in claim 17 wherein said longitudinal opening is between the magazine and cover when the cover is closed, the follower includes a generally horizontal plate within the magazine, said restraining means includes a latch that retains the follower in a raised position at an upper end of the magazine, and said mechanism includes a hand-operated latch release outside the magazine and cover.

19. A readily removable clamp-on sharpener for sharpening a rotary disk-like blade of a slicer that has a work support table at least partially surrounding the blade, said sharpener having a body portion with means for engaging a top surface of said work support table, means on said body for contacting and locating the body relative to surfaces of the table transverse to the top surface, clamping means carried by the body for urging the body into engagement with said top surface, and a sharpening surface carried by the body for movement relative to the body between a position out of contact with a blade and a position in contact with a blade and beneath the top surface of the table.

20. A sharpener as set forth in claim 19 wherein said clamping means and said sharpening surface are carried on a shaft that is rotatable and axially movable relative to said body, and wherein rotation and axial movement of the shaft both clamp the body to the table and move the sharpening surface with into engagement with the blade.

21. A readily removable clamp-on sharpener for a rotary disk-like blade that has a work-facing surface, an angularly related surface that forms a cutting edge therewith, and a member at least partially surrounding the blade with a first surface parallel to the blade work-facing surface, said sharpener having a body portion with means for engaging said surface of the member, means on said body for contacting and locating the body relative to second surfaces of the member transverse to said first surface, clamping means carried by the body for urging the body into engagement with said first surface, and a sharpening element carried by the body for movement relative to the body between a position out of contact with a said blade and a position in contact with a said blade.

22. In a slicer for comestible products having a base, a support on the base rotatable relative to the base about a generally vertical first axis, a circular blade carried by the support and rotatable relative to the support about a second axis parallel to the first, a circular generally horizontal table rotatable about its center with the support, said table having an opening offset from the center, through which the second axis extends, said table and blade being adjustable axially relative to one another, means to rotate the support, means to rotate the blade relative to the support, an upright magazine supported in a fixed position relative to the base above the table and offset from said first axis for holding upright a product supported on the table for slicing, the improvement wherein the slicer has a removable cover over the base, support, blade and table, said cover has an opening for the passage of product to be sliced, the magazine has an open upright side, a second cover is pivotally carried by the magazine to close the open upright side, and proximity switch means and switch actuator means prevent operation of the slicer unless the removable cover is in place over the base and the second cover is closed.

23. In a slicer having a rotary circular blade surrounded by a member having a product-facing surface, said surface having an opening for the blade so the blade can be flush with the surface, the improvement comprising a recess in a portion of the periphery of the surface that directly surrounds the blade, a blade sharpener that in part fits within the recess, means to secure the sharpener to the table member against said surface, and means to selectively extend the sharpener from the recess into contact with the blade.

24. In a slicer having a rotary circular blade surrounded by a product support table, said table having an opening for the blade so the blade can be flush with a top surface of the table, the improvement comprising a recess in a portion of the periphery of the table that directly surrounds the blade, a blade sharpener that in part fits within the recess, means to secure the sharpener to the table, and means to selectively extend the sharpener from the recess into contact with the blade below the top surface of the table.

* * * * *